US012016505B2

(12) United States Patent
Beck et al.

(10) Patent No.: US 12,016,505 B2
(45) Date of Patent: Jun. 25, 2024

(54) DISHWASHER FOR CLEANING ITEMS IN THE SHAPE OF DRINKING VESSELS AND COUNTER MODULE WITH SUCH A DISHWASHER

(71) Applicant: ILLINOIS TOOL WORKS INC., Glenview, IL (US)

(72) Inventors: Axel Beck, Offenburg (DE); Martin Schrempp, Biberach (DE); Adrian Boldt, Offenburg (DE); Harald Disch, Elzach (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 116 days.

(21) Appl. No.: 17/331,048

(22) Filed: May 26, 2021

(65) Prior Publication Data

US 2022/0104681 A1 Apr. 7, 2022

(30) Foreign Application Priority Data

Oct. 6, 2020 (DE) ..... 10 2020 126 121.7

(51) Int. Cl.
*A47L 15/00* (2006.01)
*A47L 15/42* (2006.01)

(52) U.S. Cl.
CPC ..... *A47L 15/0073* (2013.01); *A47L 15/0015* (2013.01); *A47L 15/4285* (2013.01)

(58) Field of Classification Search
None
See application file for complete search history.

(56) References Cited

U.S. PATENT DOCUMENTS 1,502,131 A 7/1924 Vaudreuil
1,617,021 A * 2/1927 Mitchell ..... A47L 15/23 134/176

(Continued)

FOREIGN PATENT DOCUMENTS

CN 106073683 A 11/2016
CN 107374538 A 11/2017

(Continued)

OTHER PUBLICATIONS

PCT, International Search Report and Written Opinion, International Application No. PCT/US2021/050408; dated Dec. 22, 2021, 14 pages.

*Primary Examiner* — Rita P Adhlakha
(74) *Attorney, Agent, or Firm* — THOMPSON HINE LLP

(57) ABSTRACT

A dishwasher (1) includes a treatment zone (3) and a conveyor apparatus (4) for transporting washware items (2) from a placement area (5) through the treatment zone (3) to a removal area (6). A washing and/or rinsing system has at least one washing and/or rinsing pump (9) and washing and/or rinsing nozzles. The dishwasher (1) is spatially partitioned into an over table area (7), which, when the dishwasher (1) is used as intended, is positioned above a counter level (13), and an under table area (8), which, when the dishwasher (1) is used as intended, is positioned below the counter level (13), wherein the placement area (5), the removal area (6) and the treatment zone (3) are respectively part of the over table area (7), and wherein at least the washing and/or rinsing pump (9) of the washing and/or rinsing system is part of the under table area (8).

19 Claims, 9 Drawing Sheets

(56) References Cited

U.S. PATENT DOCUMENTS

| | | | | |
|---|---|---|---|---|
| 1,693,780 | A | 12/1928 | Griffiths | |
| 1,814,508 | A | 7/1931 | Griffiths | |
| 3,092,120 | A | 6/1963 | Hilger et al. | |
| 3,460,878 | A * | 8/1969 | Peterson et al. | A47L 15/0089 312/297 |
| 3,486,939 | A | 12/1969 | Pinckard | |
| 3,886,959 | A | 6/1975 | Stott | |
| 3,940,944 | A | 3/1976 | Lapeyre | |
| 3,942,545 | A | 3/1976 | Flynn | |
| 4,825,887 | A | 5/1989 | Nezworski | |
| 4,832,064 | A * | 5/1989 | Nezworski | A47L 15/243 134/146 |
| 5,522,410 | A | 6/1996 | Meilleur | |
| 6,276,373 | B1 | 8/2001 | Gotfricd | |
| 6,394,285 | B1 | 5/2002 | Arthurs et al. | |
| 10,945,582 | B1 | 3/2021 | Morman et al. | |
| 2002/0020435 | A1 | 2/2002 | Varpio | |
| 2005/0072449 | A1 | 4/2005 | Alpert et al. | |
| 2006/0060215 | A1 | 3/2006 | Lcc | |
| 2007/0125729 | A1 | 6/2007 | Krueger | |
| 2008/0149149 | A1 | 6/2008 | Ryu et al. | |
| 2011/0290804 | A1 | 12/2011 | Kohles et al. | |
| 2012/0111372 | A1 | 5/2012 | Hesterberg et al. | |
| 2012/0298146 | A1* | 11/2012 | Padtberg | A47L 15/0049 134/124 |
| 2013/0099715 | A1 | 4/2013 | Fuhgc | |
| 2013/0340790 | A1 | 12/2013 | Lemley | |
| 2014/0285075 | A1 | 9/2014 | Lundberg et al. | |
| 2015/0107630 | A1 | 4/2015 | Varnals et al. | |
| 2016/0007824 | A1 | 1/2016 | Maicr | |
| 2016/0177493 | A1 | 6/2016 | Pittalis et al. | |
| 2016/0324397 | A1 | 11/2016 | Jung et al. | |
| 2016/0338566 | A1 | 11/2016 | Shabtai | |
| 2018/0338666 | A1 | 11/2018 | Seewang et al. | |
| 2019/0301073 | A1 | 10/2019 | Kessler et al. | |
| 2021/0259509 | A1 | 8/2021 | Sperry | |
| 2021/0369076 | A1 | 12/2021 | McGinness et al. | |
| 2022/0079413 | A1 | 3/2022 | Longo | |

FOREIGN PATENT DOCUMENTS

| | | | |
|---|---|---|---|
| CN | 109394119 | A1 | 3/2019 |
| CN | 107233058 | B | 6/2019 |
| CN | 109984703 | A | 7/2019 |
| CN | 111166264 | A | 5/2020 |
| CN | 112190207 | A | 1/2021 |
| CN | 112315397 | A | 2/2021 |
| DE | 2727067 | A1 | 1/1979 |
| DE | 4136923 | A1 | 5/1993 |
| DE | 4241064 | A1 | 6/1994 |
| DE | 19644438 | A1 | 4/1998 |
| DE | 19644438 | A1 | 4/1998 |
| DE | 20017158 | U1 | 12/2000 |
| DE | 20317895 | U1 | 2/2004 |
| DE | 102013226080 | A1 | 6/2015 |
| DE | 102018103585 | A1 | 9/2018 |
| DE | 102017129799 | A1 | 6/2019 |
| DE | 102019119462 | A1 | 1/2021 |
| EP | 0048519 | B1 | 12/1984 |
| EP | 0600125 | A1 | 6/1994 |
| EP | 0593876 | B1 | 4/1997 |
| EP | 1532916 | A2 | 5/2005 |
| EP | 2228000 | B1 | 7/2015 |
| EP | 3015043 | A1 | 5/2016 |
| EP | 3357398 | A1 | 8/2018 |
| GB | 565183 | A | 10/1944 |
| JP | 2002209691 | A | 7/2002 |
| KR | 20040087763 | A | 10/2004 |
| KR | 20060065289 | A | 6/2006 |
| KR | 20060068402 | A | 6/2006 |
| KR | 101757580 | B1 | 7/2017 |
| KR | 20180068569 | A | 6/2018 |
| WO | WO 2005044473 | A1 | 5/2005 |
| WO | WO 2009011524 | A1 | 1/2009 |
| WO | WO 2018087519 | A1 | 5/2018 |
| WO | WO 2020186344 | A1 | 9/2020 |
| WO | WO 2021011604 | A1 | 1/2021 |
| WO | WO 2021116749 | A1 | 6/2021 |

* cited by examiner

DISHWASHER FOR CLEANING ITEMS IN THE SHAPE OF DRINKING VESSELS AND COUNTER MODULE WITH SUCH A DISHWASHER

TECHNICAL FIELD

The present invention relates generally to the technical field of commercial dishwashing and more specifically to dishwashers according to the preamble of independent Claim 1.

The invention accordingly relates in particular to a dishwasher for cleaning washware items in the form of drinking vessels, in particular in the form of drinking cups, mugs, glasses or bottles, wherein the dishwasher comprises at least one and preferably exactly one treatment zone and preferably at least one conveyor apparatus for transporting the washware items to be cleaned from a placement area of the dishwasher through the at least one treatment zone of the dishwasher to a removal area of the dishwasher.

The placement area of the dishwasher is in particular the soiled-side input area, which is configured such that the washware to be cleaned in the at least one treatment zone of the dishwasher can manually be placed in there. The removal area of the dishwasher, on the other hand, is in particular the clean-side output area, which is configured to output the washware cleaned in the at least one treatment zone of the dishwasher so that they can then be removed manually.

The dishwasher according to the invention in particular further comprises a washing and/or rinsing system having at least one washing and/or rinsing pump and having washing and/or rinsing nozzles, via which cleaning liquid, in particular washing and/or rinsing liquid, can be sprayed onto the washware items to be cleaned in the at least one treatment zone of the dishwasher.

Dishwashers of the aforementioned type, in particular dishwashers comprising a conveyor apparatus for transporting the washware items to be cleaned through the at least one treatment zone of the dishwasher, are typically used in the commercial sector. Unlike domestic dishwashers, in which the washware to be cleaned remains stationary in the dishwasher during cleaning, in these conveyor dishwashers the washware is transported through different treatment zones of the machine.

Such a conveyor dishwasher is known from the document DE 19 644 438 A1, for example. Looking in the conveying direction of the washware items, this conveyor dishwasher successively comprises a preclearing zone with preclearing nozzles for removing coarse soiling on the washware, at least one wash zone with washing nozzles for spraying washing liquid onto the washware, a prerinse zone with prerinsing nozzles and a fresh water rinse zone with rinsing nozzles. The rinsing nozzles spray rinsing liquid, in particular fresh water, onto the washware. The sprayed rinsing liquid enters a prerinse tank, from which it is conveyed to the prerinsing nozzles via a pump line. The prerinsing liquid sprayed by the prerinsing nozzles flows back into the prerinse tank. A portion of the prerinsing liquid sprayed by the prerinsing nozzles is passed through a baffle into the wash tank of the last wash zone. With the aid of a liquid cascade system, liquid can flow against the conveying direction of the washware from the prerinse tank into the last wash tank and from there to a tank which collects the liquid sprayed by the preclearing nozzles in the preclearing zone.

In contrast to the batch processes of stationary programmed machines, such as domestic dishwashers or under-counter dishwashers, continuous operation is possible because conveyor dishwashers transport the washware through different treatment zones (in particular wash zones and rinse zones) of the machine. The disadvantage of conveyor dishwashers, however, is the relatively large space requirement in the installation room (scullery).

Nevertheless, there is an increasing need to utilize the advantages of a conveyor dishwasher in applications in which only a small installation surface is available.

Nowadays hot beverage vending machines, in particular coffee machines, of various models and sizes are almost always available for self-service in hotels, company cafeterias, public buildings, hospitals, schools and highway rest areas. These hot beverage vending machines are typically configured to fill cups with a selected hot beverage; in vending machine setups in businesses or public buildings, however, plastic cups are used as well.

At the same time, due to ecological considerations, the use of plastic cups is decreasing more and more, specifically in favor of reusable dishes (glasses, cups, etc.).

Usually a standard industrial dishwasher is used to clean the cups, glasses, etc. (hereinafter also referred to as "drinking vessel") after use. For this purpose, dirty washware items are collected and transported to the dishwasher, whereby the dishwasher is typically not located directly in the vicinity of the hot beverage vending machine, cleaned there, and then returned to the hot beverage station or the hot beverage vending machine.

Switching the hot beverage vending machines from disposable dishes to reusable dishes therefore creates problems in terms of the logistics that have to be provided, in particular in the form of workers to carry out the individual process steps related to collecting the soiled, reusable dishes, loading a usually externally provided dishwasher and returning the cleaned dishes to the hot beverage vending machine.

The provision of a conventional conveyor dishwasher known from the state of the art in the immediate vicinity of a hot beverage vending machine is not possible, because such conveyor dishwashers require a relatively large amount of space in the installation room, which is usually not to be found in the vicinity of hot beverage vending machines.

SUMMARY

The underlying object of the invention is therefore to further develop a dishwasher of the abovementioned type such that it has a particularly compact structure, so that the dishwasher can also be used in applications in which conventional conveyor dishwashers cannot be used due to a lack of installation surface.

This object is achieved in particular by the subject matter of independent claim 1, whereby advantageous further developments of the dishwasher according to the invention are specified in the dependent claims.

The invention accordingly relates in particular to a dishwasher for cleaning washware items in the form of drinking vessels, wherein the dishwasher comprises at least one treatment zone and preferably at least one conveyor apparatus for transporting the washware items to be cleaned from a placement area of the dishwasher through the at least one treatment zone of the dishwasher to a removal area of the dishwasher. The dishwasher according to the invention further comprises a washing and/or rinsing system having at least one washing and/or rinsing pump and washing and/or rinsing nozzles, via which cleaning liquid, in particular washing and/or rinsing liquid, can be sprayed onto the washware items to be cleaned in the at least one treatment zone.

According to the invention, it is in particular provided that the dishwasher is spatially partitioned into an over table area, which, when the dishwasher is used as intended, is positioned above a counter level, and an under table area, which, when the dishwasher is used as intended, is positioned below the counter level, wherein the placement area, the removal area and the at least one treatment zone of the dishwasher are respectively part of the over table area, and wherein at least the at least one washing and/or rinsing pump of the washing and/or rinsing system is part of the under table area.

The advantages that can be achieved with the dishwasher according to the invention are obvious: the dishwasher according to the invention makes it possible to selectively clean the deposited washware individually, so that the dishwasher is in particular suitable for cleaning reusable drinking vessels, such as coffee cups, whereby the dishwasher can be set up directly by a beverage vending machine, in particular a hot beverage vending machine, or in close proximity to a beverage vending machine, in particular a hot beverage vending machine.

Beverage vending machines nowadays, in particular hot beverage vending machines, are typically equipped with a means for dispensing disposable containers which are thrown away as waste after use, or are subject to mandatorily be taken back after legal regulations come into force.

There are also beverage vending machines that do not provide or dispense containers, for which the user uses his own cup or the like that he then cleans himself after use. This consumes an unnecessary amount of fresh water if the user does not consciously use it sparingly. This accordingly also produces an unnecessarily large amount of wastewater as well as requiring paper towels or the like to dry the users' own reusable containers, which in turn are thrown away as waste.

Due to its compact structure, the conveyor dishwasher according to the invention is in particular also suitable as a reusable drinking vessel dishwasher, such as a coffee cup dishwasher, which can be set up in the immediate vicinity of the hot beverage vending machine/the coffee machine or is even a partially integral component of the hot beverage vending machine.

The conveyor dishwasher comprises an input area, into which the soiled washware (in particular a drinking vessel) is placed. The conveyor dishwasher further comprises an output area, which is spatially separate from the input area, where the clean washware can be removed.

The washware (drinking vessels, such as cups, glasses, etc.) can be loaded and also removed individually (i.e. one after the other); but loading in smaller groups is generally possible too.

The dishwasher according to the invention is in particular a type of hybrid dishwasher, in which the technology of stationary programmed machines for batch processes is combined with the technology of conveyor dishwashers configured for continuous operation. On the one hand, the dishwasher according to the invention has the advantage of stationary programmed machines designed for a batch process, while, on the other hand, the advantage of conveyor dishwashers is being utilized as well. The space needed to set up the dishwasher according to the invention corresponds to no more than the space needed for a dishwasher configured as a stationary programmed machine, while at the same time enabling continuous operation of the dishwasher as is known in conveyor dishwashers and which can be listed there as an advantage.

In this context it is in particular conceivable that the conveyor apparatus is configured to selectively either transport a predetermined group of washware items to be cleaned in batches from the placement area through the at least one treatment zone and then deliver the group of washware items as cleaned washware items to the removal area, or transport the washware items to be cleaned individually from the placement area through the at least one treatment zone and then deliver them to the removal area as cleaned washware items. In particular individualized treatment and individualized delivery of the treated washware items to the removal area is thus possible.

In other words, a user of the dishwasher can place his personal cup in the placement area of the dishwasher, whereby it is ensured that said personal cup is also provided at the removal area in a manner in which it is recognizable as such.

The dishwasher is thus in particular suitable for coffee shops in which customers bring their own cup, but said cup has to be cleaned on site before being filled with a hot beverage, for example. The cup to be cleaned can then be transported individually from the placement area through the treatment zone and then delivered to the removal area.

By partitioning the dishwasher into an under table area which substantially houses the technology and an over table area which comprises the washing and loading area, the dishwasher according to the invention can be ideally integrated in particular into a counter system, in particular that of a coffee shop.

It is useful for the placement area of the dishwasher to be accessible from the area assigned to the customer of the coffee shop, in particular exclusively from this area of the counter system, whereas the removal area of the dishwasher is accessible from the area of the counter system assigned to the counter personnel. In terms of commercial dishwashing, the placement area of the dishwasher equates to the "unclean area." This "unclean area" of the dishwasher, which may be part of the counter system, is preferably accessible only from the area of the counter system assigned to the customer. This ensures a reliable separation between the area "behind the counter" and the area "in front of the counter."

This measure in particular minimizes or even completely eliminates the risk of contamination of the surroundings by containers that are not or not properly cleaned (cups, etc.) in the area of the operational equipment necessary for filling the containers.

On the other hand, in terms of commercial dishwashing, the removal area of the dishwasher equates to the "clean area." This "clean area" of the dishwasher, which may be part of the counter system, is preferably accessible only by the counter personnel.

This measure ensures that no customer-owned containers, in particular cups, for example, can enter areas of businesses in which perishable food is handled openly. This in particular effectively prevents the handling of customer-owned reusable containers by the service personnel "behind the counter" without prior hygienically perfect treatment of the reusable containers.

All of the components associated with the technology of the dishwasher are preferably integrated into the under table area of the dishwasher in order to keep the area above the counter as free as possible, which is a basic requirement for the integration of the dishwasher into a counter system. According to implementations of the dishwasher according to the invention, at least one of the following components is at least partly integrated into the under table area of the dishwasher:

- a rinse aid dosing system for in particular selective and/or as needed dosing of rinse aid to the cleaning liquid to be sprayed in the at least one treatment zone;
- a cleaner dosing system for in particular selective and/or as needed dosing of a cleaner chemical to the cleaning liquid to be sprayed in the at least one treatment zone;
- a wash tank for at least temporarily storing the cleaning liquid to be sprayed in the at least one treatment zone and/or for temporarily storing the cleaning liquid sprayed in the at least one treatment zone;
- a rinsing liquid tank for providing liquid to be sprayed in the at least one treatment zone, to which rinse aid is added as necessary;
- a wastewater tank for at least temporarily storing wastewater produced during the cleaning of the washware items; and/or
- a water heater (booster) for in particular selective and/or as needed heating of the cleaning liquid to be sprayed in the at least one treatment zone.

Of course, the above list is not to be considered to be exhaustive. There is also no need to further mention that not all of the abovementioned components associated with the "technology" of the dishwasher have to be integrated in the under table area of the dishwasher, in particular fully integrated.

In a preferred implementation of the dishwasher, the dishwasher comprises a body having an upper horizontal plane which is positioned below the counter level, whereby the under table area of the dishwasher is defined or formed by the body.

The term "body" used here refers in particular to the supporting part of the dishwasher (support frame). The body can comprise side portions, an upper and lower floor, and a rear wall, although this is not absolutely necessary. Fixed middle sides, fixed intermediate floors and front portions can be part of the body as well.

The body of the dishwasher is preferably supported by in particular height-adjustable feet or by castors or by an in particular height-adjustable substructure, base, frame or the like. With this measure, the counter height, i.e. the counter level of the dishwasher, can be adjusted in vertical direction, and in particular adapted to counter concepts or counter systems, in particular already existing counter systems.

In this context, it is in particular conceivable that the upper horizontal plane of the body is configured at least partially as an upper floor. This measure allows the dishwasher to be integrated directly into an existing counter system without interrupting the counter level.

In the region of the at least one treatment zone, the upper floor of the body should preferably comprise at least one passage or opening, through which at least cleaning liquid can be transferred from the under table area, i.e. from the technology accommodated in the under table area, to the over table area, and in particular to the at least one treatment zone of the dishwasher, and vice versa.

The conveyor apparatus is preferably disposed at least partly in the over table area of the dishwasher, specifically in particular below the at least one treatment zone. For this purpose, it is useful for the conveyor apparatus to be disposed at least partly in a base provided at least partly in the under table area of the dishwasher.

In a conceivable implementation of the solution according to the invention, it is provided that the conveyor apparatus of the dishwasher comprises at least one conveying track, in particular in the form of a conveyor belt, wherein said at least one conveying track is configured to pass through the at least one treatment zone of the dishwasher. In this context it is in particular conceivable that the width of the conveying track is selected to be appropriately narrow. In a preferred implementation of the dishwasher according to the invention, the at least one conveying track therefore has an effective width of preferably no more than 30 cm and even more preferably no more than 15 cm.

For larger coffee stores in particular, it is advantageous for the conveyor apparatus to comprise at least two parallel conveying tracks, in particular in the form of a conveyor belt, in order to increase the cleaning capacity of the dishwasher. In order to ensure that each of these two conveying tracks can individually transport the washware items through the at least one treatment zone, a correspondingly (small) width of the conveying tracks should be selected, whereby an effective width of no more than 30 cm and preferably no more than 15 cm has in particular proven to be advantageous.

The dishwasher according to the invention is advantageously implemented either as a so-called "linear machine" or as a so-called "carousel machine". In the implementation as a linear machine, the placement area, the at least one treatment zone and the removal area of the dishwasher are disposed in series such that the placement area and the removal area are disposed opposite one another with the interposition of the at least one treatment zone.

In the implementation as a carousel machine, on the other hand, it is provided that, when viewed from above, the placement area, the at least one treatment zone and the removal area of the dishwasher are disposed in a circle or at least in a circular segment.

In the implementation as a linear machine, the conveyor apparatus of the dishwasher is preferably configured to transport the washware items, in particular in batches or individually, in a translatory movement from the placement area through the at least one treatment zone to the removal area.

In the implementation as a carousel machine, on the other hand, it is preferably provided that the conveyor apparatus is configured to transport the washware items, in particular in batches or individually, at least partially in a circular movement from the placement area through the at least one treatment zone to the removal area.

In the configuration as a linear machine, the conveyor apparatus should be in particular configured such that, especially when the washware items are transported through the at least one treatment zone, the translatory movement of the washware items is preferably a non-uniform translatory movement and even more preferably a translatory movement that is temporally interrupted and/or delayed, in which the washware items in the at least one treatment zone are temporarily stopped and/or in which the movement of the washware items is delayed. This makes it possible to adapt the contact times of the washware items in the at least one treatment zone, in particular to the degree of soiling of the washware items.

In the configuration as a carousel machine, the conveyor apparatus should be in particular configured such that, especially when the washware items are transported through the at least one treatment zone, the movement of the washware items is preferably a non-uniform movement and even more preferably a movement that is temporally interrupted and/or delayed, in which the washware items in the at least one treatment zone of the dishwasher are temporarily stopped and/or in which the movement of the washware items is delayed.

It is in particular advantageous that the dishwasher comprises a suitable control device, which is configured to control the at least one conveyor apparatus such that the at least one conveyor apparatus transports the washware items to be cleaned in particular non-continuously from the placement area of the dishwasher through the at least one treatment zone to the removal area of the dishwasher.

In this context, "non-continuously" means that the washware items to be cleaned are transported from the placement area into the at least one treatment zone with the aid of the conveyor apparatus, for example, the conveyor apparatus then stops and the washware items are cleaned while they are stationary in the treatment zone (washing phase, rinsing phase or optional subsequent drying phase and a possibly provided disinfecting phase), and the cleaned washware is then transported to the removal area with the aid of the conveyor apparatus. Carrying out different treatments in chronological succession in one and the same treatment zone reduces the space requirement of the dishwasher.

Alternatively, however, it is of course also conceivable for the dishwasher to comprise a control device, which is configured to control the at least one conveyor apparatus such that the at least one conveyor apparatus transports the washware items to be cleaned continuously, and in particular at a previously defined or definable transport speed, through the at least one treatment zone. In this context, however, at least two treatment zones should be disposed one behind the other viewed in the conveying direction of the washware items.

In the case of dishwashers implemented as linear machines, endless circulating conveyor belts in particular are suitable conveyor apparatuses.

In the case of dishwashers implemented as carousel machines, the conveyor apparatus can comprise a horizontal and in particular circular placement surface, which can be rotated about a vertical axis of rotation relative to the machine frame of the dishwasher, whereby the placement surface is preferably implemented as a screen or lattice.

The placement area, the at least one treatment zone and the removal area of the dishwasher should be disposed with respect to the placement surface of the conveyor apparatus such that at all times a first circular segment area of the placement surface is in the placement area, a second circular segment area of the placement surface is in the region of the at least one treatment zone and a third circular segment area of the placement surface is in the removal area, whereby the first, second and third circular segment area are in particular preferably the same size. A circulating system for transporting the washware items to be cleaned from the placement area through the at least one treatment zone to the removal area of the dishwasher can thus be implemented. Of course, other solutions are possible here as well.

As already indicated above, the dishwasher should be associated with a control device. In particular the treatment parameters necessary and/or desired for cleaning the washware items (temperature of the cleaning liquid, nozzle pressure, dwell time, etc.) can be selected and/or set via the control device.

According to preferred further developments of the dishwasher according to the invention, the control device is in particular configured to control the washing and/or rinsing system of the dishwasher or the technology associated with the washing and/or rinsing system of the dishwasher for treating the washware items in the at least one treatment zone such that first at least one washing phase and then at least one rinsing phase, in particular a fresh water rinsing phase, is carried out in chronological succession.

In a further development of the aforementioned aspect, it is provided that the control device is further configured to control the washing and/or rinsing system of the dishwasher or the technology associated with the washing and/or rinsing system of the dishwasher for treating the washware items in the at least one treatment zone such that at least one disinfecting phase is carried out between the at least one washing phase and the at least one rinsing phase.

Field tests have shown that sufficient cleaning of the washware items can be achieved if the at least one washing phase lasts between 5 to 30 seconds and preferably between 5 to 20 seconds and even more preferably about 15 seconds.

A disinfecting phase should last between 1 to 10 seconds and preferably about 7 seconds, while the rinsing phase lasts between 1 to 10 seconds, preferably between 2 to 8 seconds and even more preferably between 3 to 5 seconds.

Of course, significantly longer times for the washing phase, disinfecting phase and/or rinsing phase are also conceivable, but longer time periods would be disadvantageous when using the dishwasher in the counter area of a coffee shop in particular.

This aspect is based on the consideration that the dishwasher should advantageously be designed such that complete cleaning of washware items can be carried out within about 30 to 60 seconds, i.e. within the typical time period in which an order can be taken and settled by the counter personnel.

Accordingly, in particular also because the placement area of the dishwasher is accessible from the area of the counter system assigned to the customer, when ordering from the counter personnel, the customer can place his own reusable container into the dishwasher via the placement area. After the ordering and billing procedure, which typically takes between 30 to 60 seconds, the cleaned, customer-owned reusable container is then ready at the removal area of the dishwasher, specifically preferably in the immediate working area of the counter personnel. There are therefore no additional steps to be taken by the counter personnel if a customer's own reusable container is to be (re)filled.

In this context, according to preferred implementations, the control device associated with the dishwasher is configured to in particular control the conveyor apparatus of the dishwasher as a function of a selected and/or set treatment program. The control device is in particular configured to control the conveyor apparatus such that:

- washware items are transported from the placement area into the at least one treatment zone within 1 to 5 seconds and preferably within 1 to 3 seconds and even more preferably within approximately 2 seconds; and/or
- washware items are transported through the at least one treatment zone within 10 to 50 seconds and preferably within 15 to 40 seconds and even more preferably within approximately 30 seconds; and/or
- washware items are transported from the at least one treatment zone to the removal area of the dishwasher within 1 to 5 seconds and preferably within 1 to 3 seconds and even more preferably within approximately 2 seconds.

Longer durations for the respective transport of the washware items are conceivable too, of course, but the above-mentioned durations are preferred to ensure that complete cleaning and loading and unloading of the washware items can be carried out within the time window of 30 to 60 seconds.

It is generally advantageous for the control device of the dishwasher to be designed to automatically detect when a washware item has been placed into the placement area of the dishwasher, in order to then activate the conveyor apparatus and the technology associated with the washing and/or rinsing system of the dishwasher. As soon as the cleaned washware items are present at the removal area of the dishwasher, the control device should automatically deactivate the conveyor apparatus and in particular, also the technology associated with the washing and/or rinsing system of the dishwasher as long as no further washware items are detected in the placement area of the dishwasher.

The dishwasher according to the invention in particular significantly reduces resources (water, energy and chemicals), in particular when handling customer-owned reusable dishes in a counter system. Existing counter systems are not designed to make customer-owned, reusable containers available to the service personnel "behind-the-counter" in a hygienic manner. Rather, it is currently common practice for customer-owned reusable containers to be cleaned outside the counter area in a dishwasher. However, such dishwashers are typically designed to clean a large number of washware items at the same time.

In practice, this means that the offer to (re)fill customer-owned reusable containers involves the reusable containers being cleaned individually in the dishwasher that is not part of the counter system, which inevitably leads to increased water, energy and chemical consumption.

In this context, it should be noted that, per reusable cup, the dishwasher according to the invention has a fresh water consumption of about 0.2 liters to 0.3 liters at an energy consumption of 200 W/h, for example. It is thus possible to achieve water savings of between 50% to 70% and energy savings of the same magnitude.

Since the dishwasher according to the invention is in particular configured to clean individual washware items in batches, a particularly compact design of the dishwasher can be implemented.

According to a further development of the dishwasher according to the invention, it is in particular provided that a fresh water tank, which can preferably be fluidically connected, in particular as needed, to the fresh water mains, is integrated into the under table area of the dishwasher to supply the dishwasher with fresh water.

Alternatively or additionally, it is conceivable that a wastewater tank, which can preferably be fluidically connected, in particular as needed, to the wastewater system, is integrated into the under table area of the dishwasher to temporarily store wastewater produced during operation of the dishwasher.

With these provisions, an integration of a dishwasher into the counter system can also be implemented if the counter system itself is not connected or connectable to the fresh water mains and/or the wastewater system.

In this context, it can preferably be provided that a heat exchange system is associated with the wastewater tank in order to recover at least part of the thermal energy of the wastewater produced during operation of the dishwasher as needed, and use it, for example, to heat the fresh water required during operation of the dishwasher.

The dishwasher according to the invention is in particular a type of hybrid dishwasher, in which the technology of stationary programmed machines for batch processes is combined with the technology of conveyor dishwashers configured for continuous operation. On the one hand, the dishwasher has the advantage of stationary programmed machines designed for a batch process, while, on the other hand, the advantage of conveyor dishwashers is being utilized as well. The space required to set up the dishwasher is no more than the space required for a dishwasher configured as a stationary programmed machine.

Partitioning the dishwasher according to the invention into an under table area and an upper table area in particular also makes it possible to optimally utilize the area on the counter surface available to the counter personnel as a work surface, since the counter area actually "needed" by the dishwasher is only the counter area that corresponds to the placement area, the treatment zone and the removal area.

As already stated, according to further developments of the dishwasher according to the invention, the dishwasher comprises a control device to control the conveyor apparatus and the controllable components (pumps, valves, heating device, etc.) associated with the washing and/or rinsing system. The control device is preferably configured to appropriately conceptualize the transport of the washware items through the at least one treatment zone as a function of the presence or absence of washware items in the input area and/or the output area.

The dishwasher according to the invention is, as already stated, designed in particular for coffee shops. Due to its compact design, the dishwasher can be integrated into the counter concept of a coffee shop, for example. The over table area of the dishwasher preferably has a footprint having a dimension of no more than 500 mm×500 mm and preferably no more than 400 mm×400 mm and even more preferably no more than 250 mm×600 mm and even more preferably no more than 330 mm×330 mm or no more than 220 mm×380 mm. An overall height of no more than 500 mm for the over table area is preferred. The under table area of the dishwasher preferably has a footprint having a dimension of no more than 400 mm×600 mm and preferably no more than 300 mm×600 mm.

According to implementations of the dishwasher, the dishwasher comprises a door, for example a Tambour door, for closing an access opening leading to the placement area of the dishwasher as needed. It is also possible to provide a splash curtain (splash cloth) at the access opening instead of a door.

It is in particular advantageous that the at least one treatment zone is associated with an exhaust device for suctioning off steam, which is likewise integrated into the under table area of the dishwasher, for example. Alternatively or additionally, it is advantageous to provide a corresponding splash guard to prevent steam and/or liquid from escaping the at least one treatment zone.

The access opening of the dishwasher preferably has a height of no more than 330 mm and preferably no more than 300 mm and a width of no more than 350 mm and preferably no more 260 mm. This allows drinking vessels to be placed into the placement area individually or side by side.

The over table area of the dishwasher, and in particular the controllable components of the over table area, are preferably releasably connected to the under table area or the components of the under table area, in particular via at least one quick-release coupling or plug connection.

The invention further relates to a counter module for a counter system, wherein the counter system comprises a counter area having a horizontal counter surface, and wherein the counter module comprises a dishwasher of the aforementioned type according to the invention, wherein the over table area of the dishwasher is disposed above the counter surface of the counter area and the under table area of the dishwasher is disposed below the counter surface of the counter area.

BRIEF DESCRIPTION OF THE DRAWINGS

Example embodiments of the dishwasher according to the invention are described in more detail in the following with reference to the accompanying drawings.

DETAILED DESCRIPTION

Figure 1:
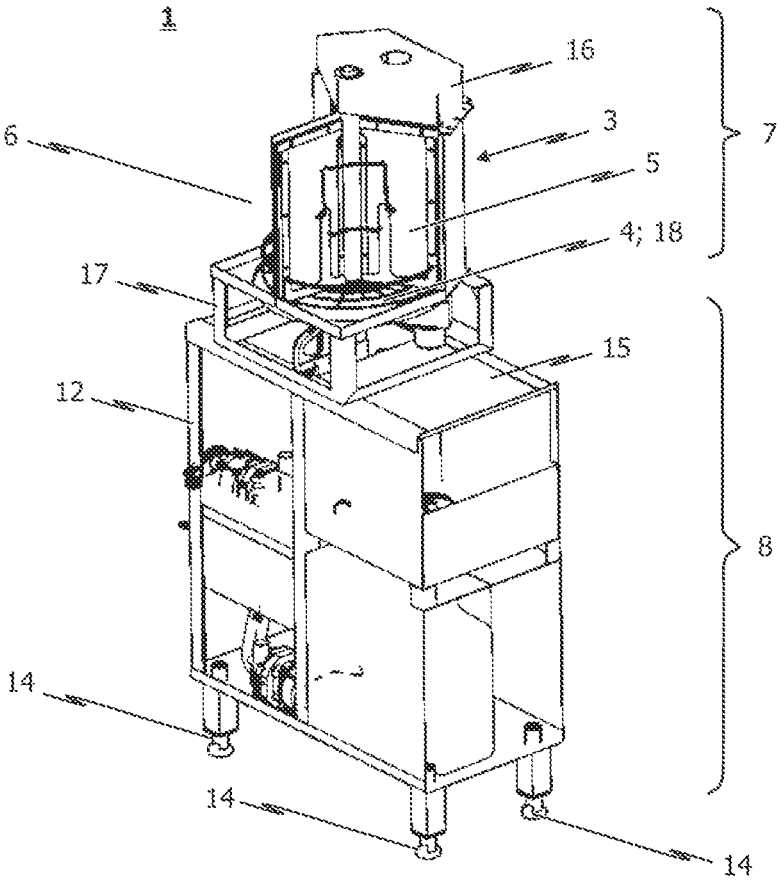
FIG. 1 schematically and in an isometric view, an example embodiment of the dishwasher according to the invention.
Figure 2A:
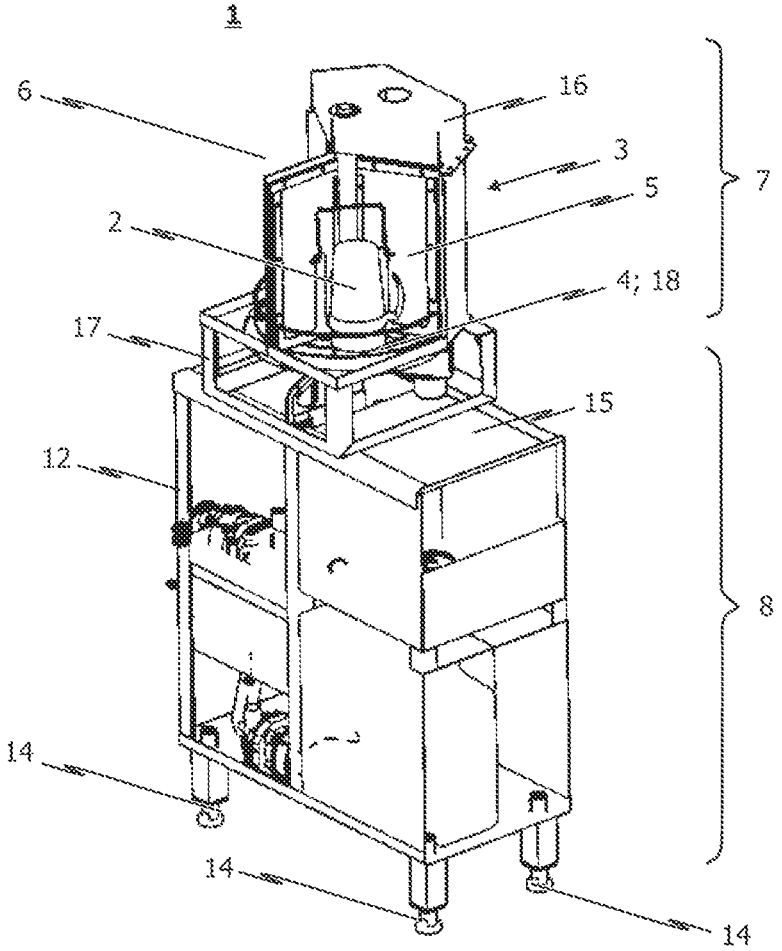
FIG. 2A schematically and in an isometric view, the example embodiment of the dishwasher according to the invention according to FIG. 1 with a washware item (drinking cup) accommodated in the placement area of the dishwasher.
Figure 2B:
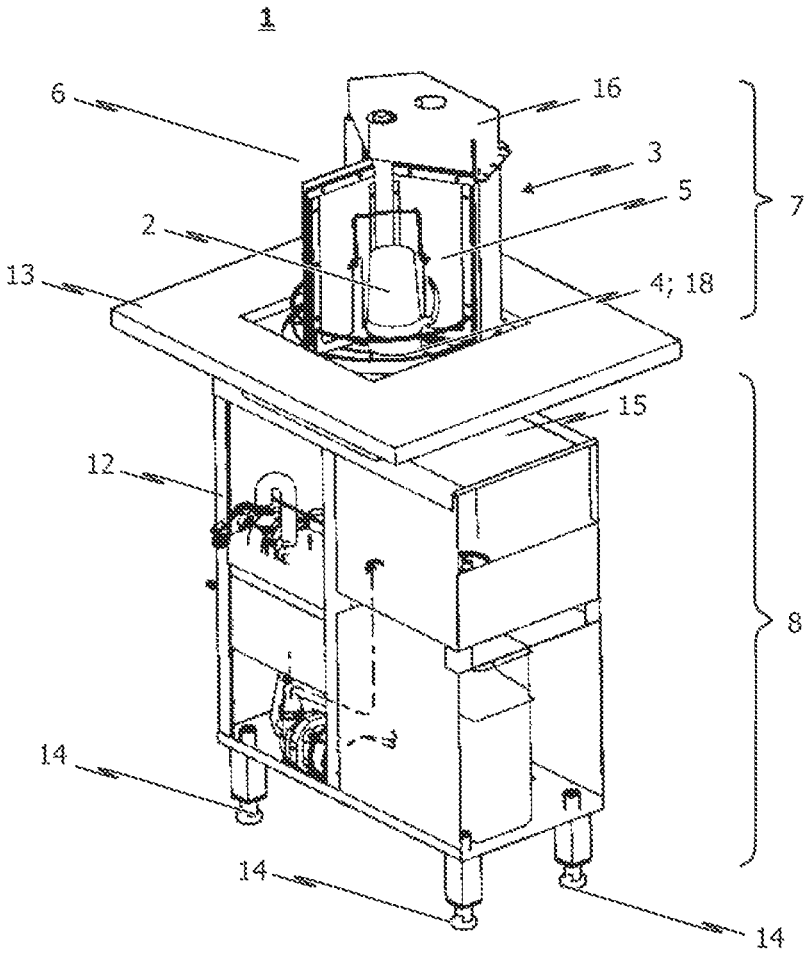
FIG. 2B schematically and in an isometric view, the example embodiment of the dishwasher according to the invention according to FIG. 1 with a washware item (drinking cup) accommodated in the placement area of the dishwasher and an indicated counter.

A first example embodiment of the dishwasher 1 according to the invention is first described in the following with reference to the illustrations in FIG. 1 to FIG. 7. The dishwasher 1 is in particular suitable for cleaning washware items 2 in the form of drinking vessels, in particular in the form of drinking cups, mugs, glasses or bottles. Of course, the dishwasher 1 is also suitable for cleaning other utensils, for example in particular coffee spoons, lids of drinking cups, etc.

For cleaning the washware items 2, the dishwasher 1 comprises a treatment zone 3 (in this case: only one) and a conveyor apparatus 4 for transporting the washware items 2 to be cleaned from a placement area 5 of the dishwasher 1 through the treatment zone 3 of the dishwasher 1 to a corresponding removal area 6 of the dishwasher 1.

The conveyor apparatus 4 is configured to transport washware items 2 individually or a previously defined or definable group of washware items 2 to be cleaned in batches from the placement area 5 through the treatment zone 3, and then deliver the washware item 2 or the group of washware items 2 in the cleaned state to the removal area 6.

More specifically, the dishwasher 1 comprises a housing 16, in which the treatment zone 3 is accommodated. In the design example shown, the treatment zone 3 is used to carry out a washing phase, then optionally a disinfecting phase, and then a rinsing phase, in chronological succession. In this context, it is in principle also conceivable for a drying phase to subsequently take place in the treatment zone 3.

The washing phase is a cleaning phase, in which the washware items 2 or the washware item 2 in the treatment zone 3 are washed with a washing liquid. The optional disinfecting phase is a cleaning or treatment phase, in which the washed washware item 2 is exposed to either a disinfectant chemical or hot fresh water or hot steam to effect appropriate disinfection. The rinsing phase is a cleaning phase, in which the washed washware item 2 and the possibly disinfected washware item 2 are rinsed with heated fresh water and optionally added rinse aid.

To be able to carry out these process steps, the dishwasher 1 preferably comprises two independent liquid systems. A first liquid system is a washing water circuit which is responsible for washing the washware item or the washware items 2, whereby washing is carried out with recirculated water from a wash tank 10 of the dishwasher 1. The other liquid system is a fresh water system, which is responsible for rinsing. As already mentioned, rinsing is carried out with fresh water, preferably fresh water from a water heater (booster). After the spraying in the treatment zone 3, the fresh water is likewise taken into the wash tank 10 of the dishwasher 1.

The primary task of rinsing is to remove any remaining suds on the washware item 2. The rinsing water flowing in the wash tank 10 during the rinsing phase is additionally used to regenerate the washing water in the wash tank 10.

Before fresh water is sprayed as a rinsing liquid by the rinsing phase and thereby fed into the wash tank 10 of the dishwasher 1, a quantity of washing liquid equal to the quantity of fresh water is preferably pumped out of the wash tank 10.

Even though only one respective treatment zone 3 is used in the example embodiments of the dishwasher 1 according to the invention shown in the drawings, it is in principle also conceivable to provide a separate treatment zone for each cleaning phase, whereby the individual treatment zones are disposed spatially separated from one another, and whereby a respective splash guard, for example in the form of a curtain, can preferably be provided between the treatment zones to prevent splashing of liquid and resoiling of the washware items 2.

In order to achieve the most compact structure of the dishwasher 1 possible, however, it is advantageous that the cleaning phases or at least some cleaning phases of the dishwasher 1 are carried out in a common treatment chamber of the dishwasher 1. In this case, the dishwasher 1 should comprise a control device, which is configured to control the conveyor apparatus 4 of the dishwasher 1 such that the washware items 2 to be cleaned are transported non-continuously through the treatment zone 3 of the dishwasher 1 by the conveyor apparatus 4.

The example embodiments of the dishwasher 1 according to the invention, as shown schematically in the drawings, are in particular characterized by the fact that they are spatially partitioned into an over table area 7 and an under table area 8. When the dishwasher 1 is used as intended, the over table area 7 is above a counter level 13 (see FIG. 2B), whereas, when the dishwasher 1 is used as intended, the under table area 8 is below the counter level 13.

It is in particular provided that the components which are necessary and can be controlled to carry out the cleaning phases in the treatment chamber are accommodated in the under table area 8. These are in particular the washing and/or rinsing pump(s) 9 of the washing and/or rinsing system of the dishwasher 1, i.e. the pumps associated with the washing water circuit and the fresh water system of the dishwasher 1.

The wash tank 10 of the dishwasher 1, and possibly a wastewater tank, are preferably likewise accommodated in the under table area 8 of the dishwasher 1. As already stated above, the wash tank 10 is used to at least temporarily store the cleaning liquid to be sprayed in the treatment zone 3 of the dishwasher 1 or to temporarily store the cleaning liquid sprayed in the treatment zone 3.

It is also advantageous if a fresh water tank or rinsing liquid tank 11, which provides at least a portion of the rinsing liquid or fresh water to be sprayed in the treatment zone 3, is accommodated in the under table area 8 of the dishwasher 1 as well.

A rinse aid dosing system for in particular selective and/or as needed dosing of rinse aid to the cleaning liquid to be sprayed in the treatment zone 3 and/or a cleaner dosing system for in particular selective and/or as needed dosing of a cleaner chemical to the cleaning liquid to be sprayed in the treatment zone 3 can also be accommodated in the under table area 8 of the dishwasher 1.

The same also applies to the water heater (booster), which is used for selective and/or as needed heating of the cleaning liquid (rinsing liquid) to be sprayed in the treatment zone 3.

In the over table area 7 of the dishwasher 1, on the other hand, preferably only the placement area 5, the removal area 6 and the treatment zone 3 of the dishwasher 1 are provided. The treatment zone 3, or a corresponding washing and/or spray nozzle system associated with the treatment zone 3, is fluidically connected to the washing liquid system and the rinsing liquid system and the corresponding components of the washing and/or rinsing system preferably accommodated in the under table area 8 of the dishwasher 1.

The washing or spray nozzle system is preferably disposed above and/or below the treatment zone 3, whereby a lateral arrangement of corresponding washing and/or spray nozzles is in principle conceivable too. In particular at least a portion of the washing and/or spray nozzles is disposed below the treatment zone 3 in a corresponding base region 17, which also belongs to the under table area 8 of the dishwasher 1, specifically with a spray direction oriented upward into the treatment zone 3.

It can be seen from the illustrations in FIG. 1, 2 and in FIGS. 4 to 7 that the example embodiment shown there comprises a body 12 having an upper horizontal plane which is positioned below the actual counter level 13. The under table area 8 of the dishwasher 1 is formed by the body 12, whereby, in this case, the body 12 comprises height-adjustable feet 14, with which the body 12 is supported.

Figure 3:
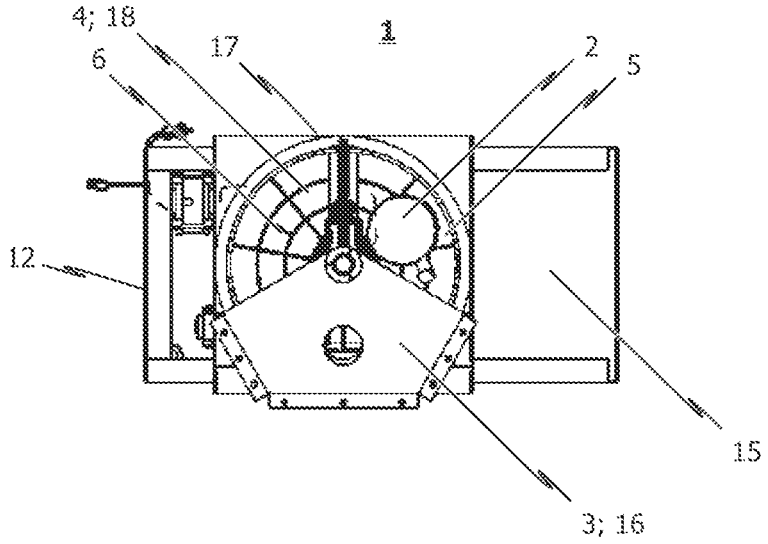
FIG. 3 schematically and in a plan view, the example embodiment of the dishwasher according to the invention according to FIG. 2A.
Figure 4:
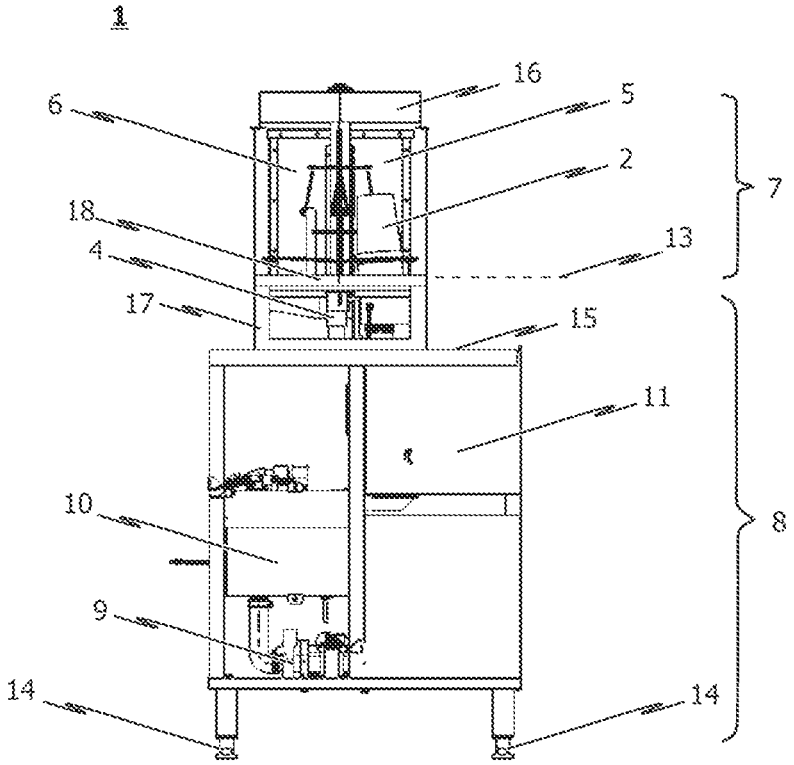
FIG. 4 schematically and in a first side view, the example embodiment of the dishwasher according to the invention according to FIG. 2A.
Figure 5:
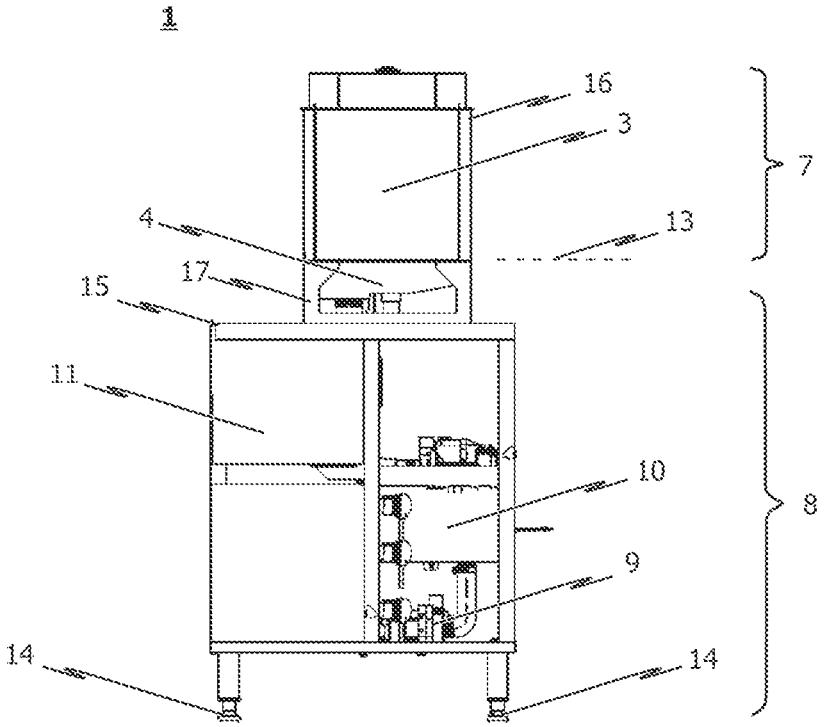
FIG. 5 schematically and in a second side view, the example embodiment of the dishwasher according to the invention according to FIG. 2A.
Figure 6:
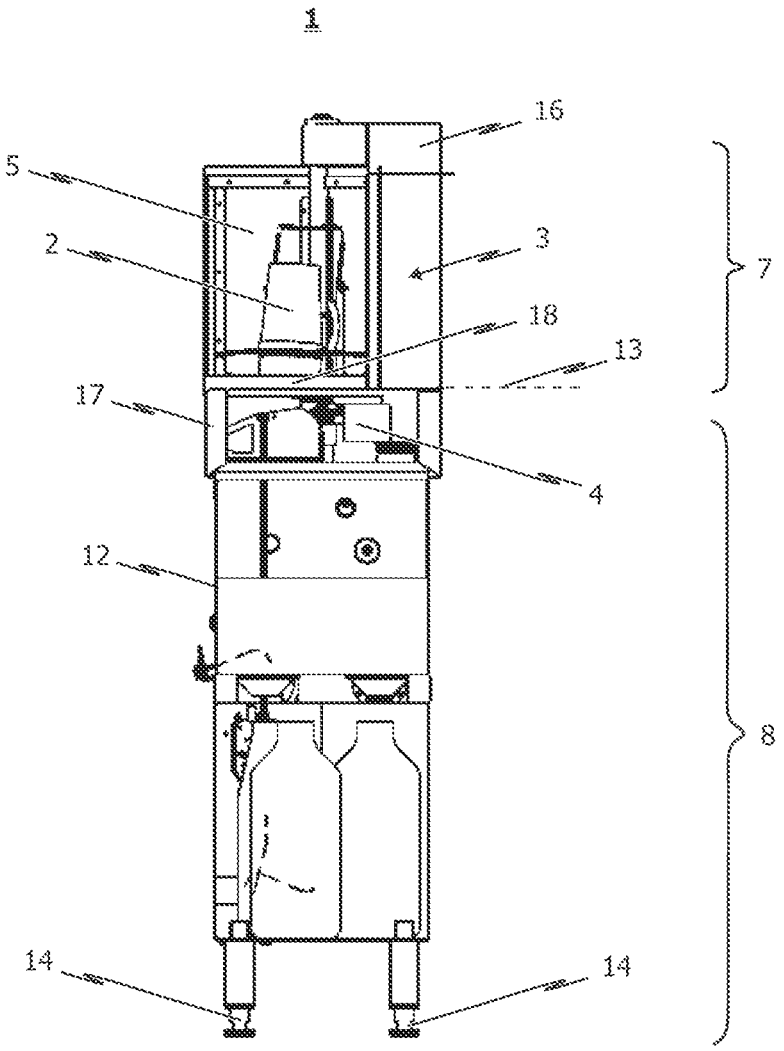
FIG. 6 schematically and in a view onto the placement area of the example embodiment of the dishwasher according to the invention according to FIG. 2A.
Figure 7:
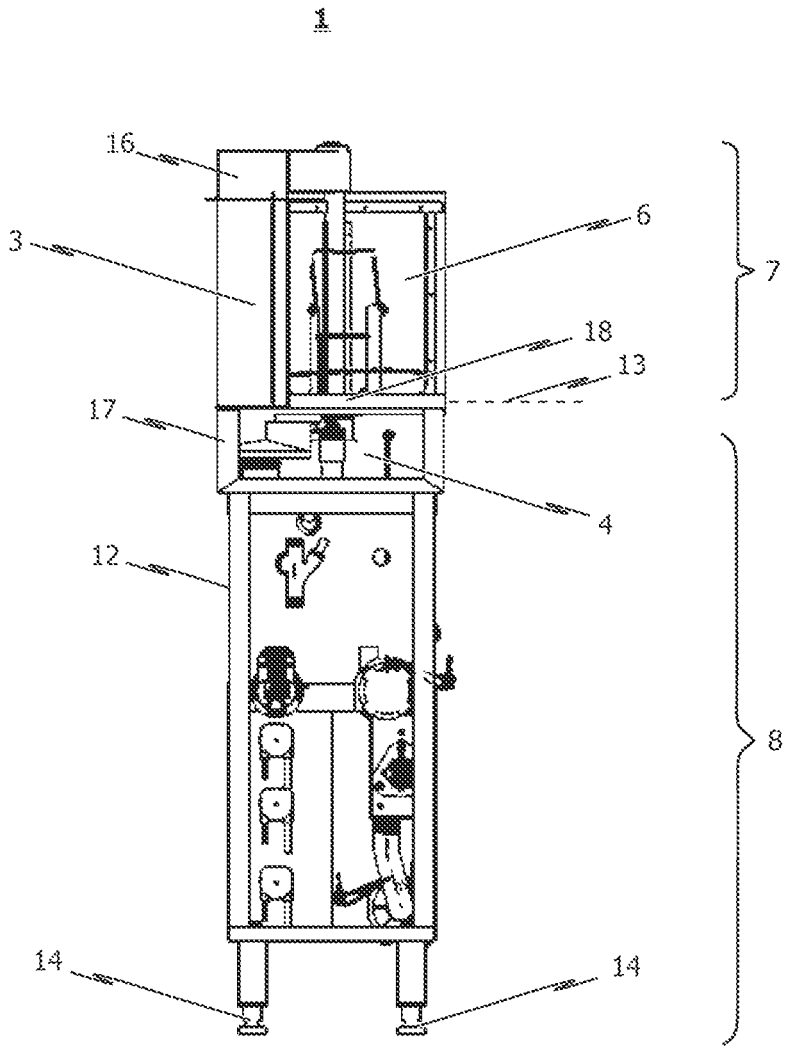
FIG. 7 schematically and in a view onto the removal area of the example embodiment of the dishwasher according to the invention according to FIG. 2A.

The plan view in FIG. 3 and the partly sectional views in FIG. 6 and FIG. 7 show that the upper horizontal plane of the body 12 is configured at least partly as the upper floor 15. In the region of the treatment zone 3 of the dishwasher 1, the upper floor 15 preferably comprises a passage or opening to ensure the liquid systems for supplying fresh water and washing water to the washing and spraying arms for the components in the under table area 8.

In the embodiment shown in the drawings, the conveyor apparatus 4 is disposed at least partly below the treatment zone 3 in the over table area 7 of the dishwasher 1, whereby, in this case, the conveyor apparatus 4 is preferably at least partly in the base 17 which is provided at least partly in the under table area 8 of the dishwasher 1.

As is evident in particular from the plan view in FIG. 3, the example embodiment of the dishwasher 1 shown there is provided with a conveyor apparatus 4, which is configured to transport the washware items 2 in batches at least partially in a circular movement from the placement area 5 through the treatment zone 3 to the removal area 6.

As the washware items 2 are transported through the treatment zone 3, the movement of the washware items 2 is temporally interrupted or at least delayed so that the washware items 2 are temporarily stopped in the treatment zone 3 or the movement of the washware items 2 is delayed.

More specifically, the dishwasher 1 according to FIG. 1 to FIG. 7 comprises a conveyor apparatus 4 having a horizontal and in particular circular placement surface 18 that is rotatable about a vertical axis of rotation relative to the machine frame of the dishwasher 1. The placement surface 18 is preferably embodied as a screen or lattice.

The placement area 5, the treatment zone 3 and the removal area 6 of the dishwasher 1 are disposed with respect to the placement surface 18 of the conveyor apparatus 4 such that at all times a first circular segment area of the placement surface 18 is in the placement area 5, a second circular segment area of the placement surface 18 is in the area of the treatment zone 3 and a third circular segment area of the placement surface 18 is in the removal area 6. In the embodiment shown, the aforementioned circular segment areas are the same size.

However, the present invention is not limited to a carousel solution as shown in the embodiment according to FIG. 1 to FIG. 7. A linear solution is in fact fundamentally conceivable as well; in this context, reference is made to the schematic illustration of the over table area 7 in FIG. 9 to FIG. 10.

In the linear solution, the placement area 5, the at least one treatment zone 3 and the removal area 6 of the dishwasher 1 are disposed in series such that the placement area 5 and the removal area 6 are disposed opposite one another with the interposition of treatment zone 3.

If a conveyor apparatus 4 is used (which in particular for the linear solution is not absolutely necessary), it should be configured to transport the items of washware items 2, in particular in batches, in a translatory movement from the placement area 5 through the treatment zone 3 to the removal area 6.

In particular if only one treatment zone 3 is being used, in particular when the washware items 2 are transported through the only treatment zone 3, the translatory movement of the washware items 2 should preferably be a non-uniform translatory movement and even more preferably a translatory movement that is temporally interrupted and/or delayed, in which the washware items 2 in the at least one treatment zone 3 are temporarily stopped and/or in which the movement of the washware items 2 is delayed.

Due to the compactness of the dishwasher 1, the loading opening of the placement area 5 can be correspondingly small. If the dishwasher 1 is used to clean drinking vessels, in particular reusable drinking vessels such as coffee cups, as in the example embodiments shown in the drawings, the loading opening of the placement area 5 can be slightly higher than the drinking vessel to be treated.

Although not shown in the drawings, the access opening of the placement area 5 of the dishwasher 1 can be associated with a guide slot corresponding to the drinking vessel to be cleaned in order to provide an orientation of the drinking vessel when the drinking vessel is placed into the placement area 5.

The dishwasher 1 preferably comprises a control device for appropriately controlling the conveyor apparatus 4 and the controllable components associated with the treatment zone 3. The control device is configured to control the conveyor apparatus 4 of the dishwasher 1 and, if applicable, the controllable components of the treatment zone 3 or the washing and rinsing system of the treatment zone 3 as a function of a presence or absence or as a function of a number of drinking vessels in the placement area 5 and/or in the removal area 6.

Due to its design and size, the dishwasher 1 according to the invention is in particular configured to be integrated into the counter concept of a coffee shop, for example, so that a dirty cup can be placed into the machine in an area in front of the counter by the customer, and the clean cup can then be removed from the machine by the personnel behind the counter after the cleaning process has been carried out, to then refill said cup directly in accordance with the customer's order. More specifically, it is in particular provided that the technology for the washing and/or rinsing system is accommodated in the under table area 8 of the dishwasher 1, so that as much space as possible is available in the over table area 7 of the dishwasher 1, so that the entire dishwasher 1 can easily be integrated into the counter concept of a coffee shop, for example.

In particular in embodiments in which the over table area 7 is embodied as a linear system (see FIGS. 8 to 10), it is advantageous for the dishwasher 1 to comprise a door, in particular a Tambour door 19, to close an access opening to the placement area 5 of the dishwasher 1 as needed. The door can be manually or automatically actuatable. If the door is automatically actuated, the placement area 5 can be associated with a sensor system, which is configured to detect the presence of a washware item in the placement area 5, whereby the sensor system actuates a door mechanism to close the door and start a treatment program of the dishwasher 1 when a washware item is detected in the placement area 5.

Figure 8:
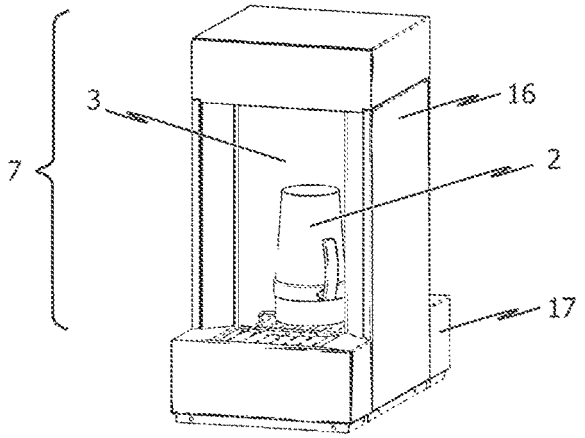
FIG. 8 schematically and in an isometric view, the over table area of a second example embodiment of the dishwasher according to the invention, specifically with a washware item (drinking cup) in the treatment zone for the dishwasher.
Figure 9:
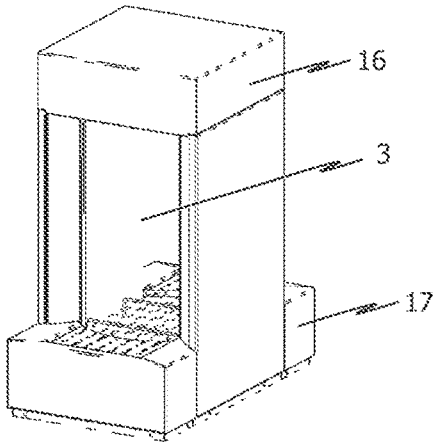
FIG. 9 schematically, and in an isometric view, the over table area according to FIG. 8, specifically without a washware item in the treatment zone of the dishwasher.
Figure 10:
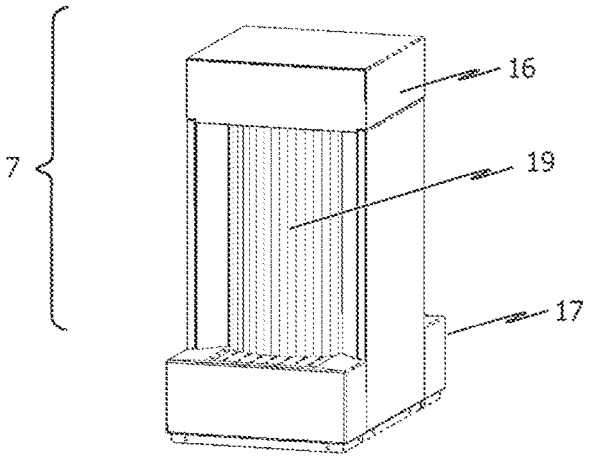
FIG. 10 schematically, and in an isometric view, the over table area of the example embodiment of the dishwasher according to the invention according to FIG. 8 or FIG. 9, specifically with a closed access opening to the treatment zone.

The embodiment in FIGS. 8 to 10 also shows that, in particular in over table areas which are embodied as a linear system in which the placement area 5 and the removal area 6 are disposed on opposite sides, a conveyor apparatus 4 is not necessarily needed. More specifically, in the over table area 7 shown in FIG. 8 to FIG. 10, it is provided that the washware item 2 to be cleaned is placed manually in the treatment zone 3.

Figure 11A:
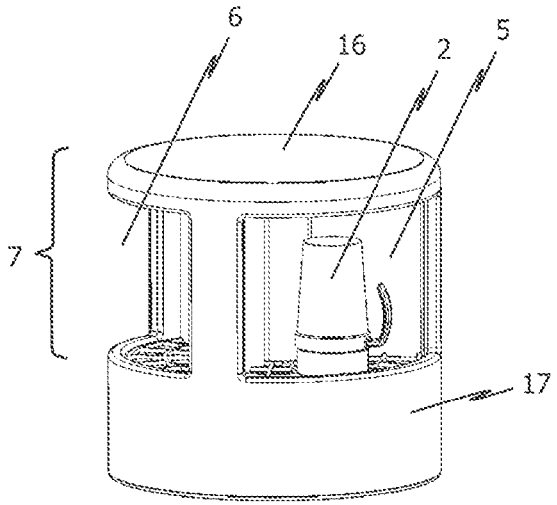
FIG. 11A schematically and in an isometric view, the over table area of a further example embodiment of the dishwasher according to the invention, specifically in a state in which a washware item (drinking vessel) is accommodated in the removal area of the dishwasher.
Figure 11B:
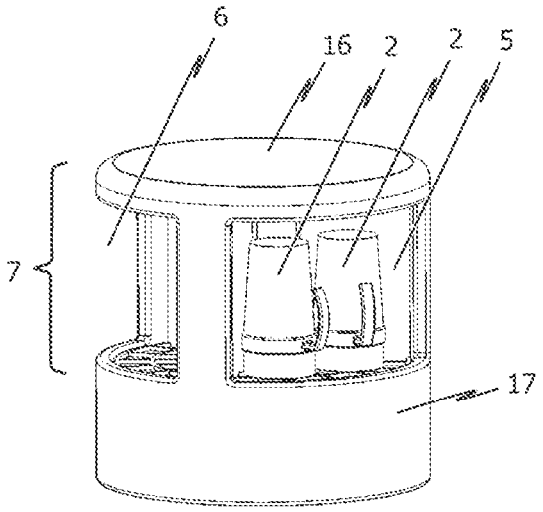
FIG. 11B schematically and in an isometric view, the example embodiment of the over table area according to FIG. 11A, specifically in a state in which two washware items (drinking vessels) are accommodated in the removal area of the dishwasher.
Figure 11C:
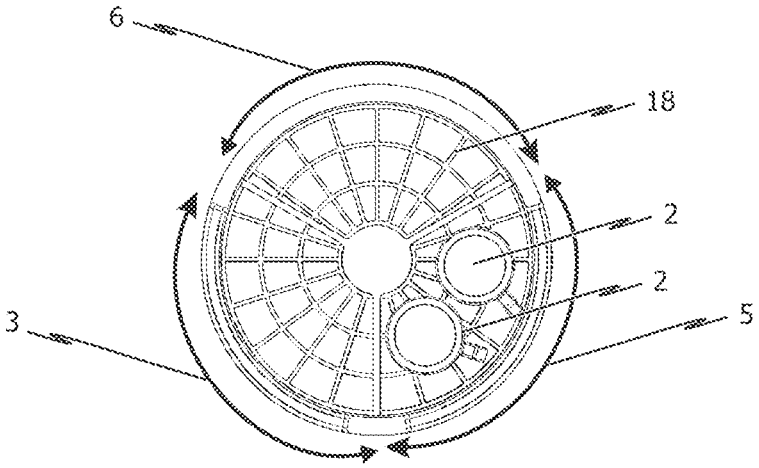
FIG. 11C schematically and in a sectional plan view, the example embodiment of the over table area of the dishwasher according to FIG. 11B.

A further configuration of an over table area 7 of the dishwasher 1 according to the invention, in which the conveyor apparatus 4 is configured as a carousel, is provided in FIG. 11A to FIG. 11C.

The invention is not limited to the embodiments shown in the drawings, but results when all of the features disclosed herein are considered together.

LIST OF REFERENCE SIGNS

1 Dishwasher
2 Washware item
3 Treatment zone
4 Conveyor apparatus
5 Placement area
6 Removal area
7 Over table area
8 Under table area
9 Washing and/or rinsing pump
10 Wash tank
11 Rinsing liquid tank
12 Body
13 Counter level
14 Height-adjustable feet
15 Upper floor of the body
16 Housing for the treatment zone
17 Base
18 Circular placement surface of the conveyor apparatus
19 Tambour door

What is claimed is:

1. A dishwasher for cleaning washware items in the form of drinking vessels, wherein the dishwasher comprises at least one treatment zone and a placement area and a removal area, and wherein the dishwasher further comprises a washing and/or rinsing system having at least one washing and/or rinsing pump and washing and/or rinsing nozzles, via which cleaning liquid, can be sprayed onto the washware items to be cleaned in the at least one treatment zone, wherein the dishwasher is spatially partitioned into an over table area, which, when the dishwasher is used as intended, is positioned above a counter level, and an under table area, which, when the dishwasher is used as intended, is positioned below the counter level, wherein the placement area, the removal area and the at least one treatment zone are respectively part of the over table area, and wherein at least the at least one washing and/or rinsing pump of the washing and/or rinsing system is part of the under table area;

wherein the treatment zone is accommodated within a housing, wherein a counter structure surrounds and extends outward beyond front, rear, left and right sides of the housing and the housing projects upward through an opening of the counter structure, wherein the front side is a placement side of the housing and includes a loading opening and the rear side is a removal side of the housing and includes an unloading opening;

wherein the counter structure is sized and configured such that an area on an upper surface of the counter structure at the removal side of the housing is available as a work surface, wherein the counter level is defined by an upper surface of the counter structure.

2. The dishwasher according to claim 1, wherein the washing and/or rinsing system further comprises at least one of the following components:

a cleaner dosing system for selective and/or as needed dosing a cleaner chemical to the cleaning liquid to be sprayed in the at least one treatment zone;

a wash tank for at least temporarily storing the cleaning liquid to be sprayed in the at least one treatment zone and/or for temporarily storing the cleaning liquid sprayed in the at least one treatment zone;

a rinsing liquid tank for providing rinsing liquid to be sprayed in the at least one treatment zone, to which rinse aid is added as necessary;

wherein the at least one component of the washing and/or rinsing system is part of the under table area of the dishwasher.

3. The dishwasher according to claim 1, wherein the dishwasher comprises a body having an upper horizontal plane, which is positioned below the counter level, wherein the under table area of the dishwasher is formed by the body, and wherein the body is supported by height-adjustable feet or castors or by an height-adjustable substructure, base or frame.

4. The dishwasher according to claim 3, wherein the upper horizontal plane of the body is configured at least partly as an upper floor, the surface of which is below the counter level, wherein in the region of the at least one treatment zone the upper floor comprises at least one passage or opening, via which cleaning liquid can be transferred from the under table area to the over table area and vice versa.

5. The dishwasher according to claim 1, wherein a conveyor apparatus is disposed at least partly below the at least one treatment zone in the over table area of the dishwasher, wherein the conveyor apparatus is disposed at least partly in a base which is provided at least partly in the under table area of the dishwasher.

6. The dishwasher according to claim 1 wherein the placement area, the at least one treatment zone and the removal area of the dishwasher are disposed in series such that the placement area and the removal area are disposed opposite one another with the interposition of the at least one treatment zone, and wherein a conveyor apparatus is configured to transport washware items, in batches, in a translatory movement from the placement area through the at least one treatment zone to the removal area, wherein, when the washware items are transported through the at least one treatment zone, the translatory movement of the washware items is a non-uniform translatory movement and even more a translatory movement that is temporally interrupted and/or delayed, in which the washware items are temporarily stopped in the at least one treatment zone and/or in which the movement of the washware items is delayed.

7. The dishwasher according to claim 1, wherein a conveyor apparatus is configured to transport washware items, in batches, at least partially in a circular movement from the placement area through the at least one treatment zone to the removal area, wherein when the washware items are transported through the at least one treatment zone, the movement of the washware items is a non-uniform movement that is temporally interrupted and/or delayed, in which the washware items are temporarily stopped in the at least one treatment zone and/or in which the movement of the washware items is delayed.

8. The dishwasher according to claim 7, wherein a conveyor apparatus comprises a horizontal and circular placement surface which is rotatable relative to the machine frame of the dishwasher about a vertical axis of rotation, wherein the placement surface is implemented as a screen or lattice, wherein the placement area, the at least one treatment zone and the removal area of the dishwasher are disposed with respect to the placement surface of the conveyor apparatus such that at all times a first circular segment area of the placement surface is in the placement area, a second circular segment area of the placement surface is in the region of the at least one treatment zone and a third circular segment area of the placement surface is in the removal area, wherein the first, second and third circular segment area are the same size.

9. The dishwasher according to claim 1, wherein the dishwasher is associated with a control device, via which the treatment parameters necessary and/or desired for cleaning the washware items can be selected and/or set, wherein the control device is configured to control the washing and/or rinsing system of the dishwasher for treating the washware items in the at least one treatment zone such that first at least one washing phase and then at least one rinsing phase, a fresh water rinsing phase, is carried out in chronological succession.

10. The dishwasher according to claim 9, wherein the control device is further configured to control the washing and/or rinsing system of the dishwasher for treating the washware items in the at least one treatment zone such that at least one disinfecting phase is carried out between the at least one washing phase and the at least one rinsing phase.

11. The dishwasher according to claim 9, wherein the at least one washing phase lasts between 5 to 30 seconds, wherein the disinfecting phase lasts between 1 to 10 seconds, and wherein the rinsing phase lasts between 1 to 10 seconds.

12. The dishwasher according to claim 9, wherein the control device is configured to control a conveyor apparatus as a function of a selected and/or set treatment program, wherein the control device is configured to control the conveyor apparatus such that:

washware items are transported from the placement area into the at least one treatment zone within 1 to 5 seconds; and/or washware items are transported through the at least one treatment zone within 10 to 50 seconds; and/or washware items are transported from the at least one treatment zone to the removal area of the dishwasher within 1 to 5 seconds.

13. The dishwasher according to claim 1, wherein the dishwasher has a dimension adapted to a counter size, wherein the footprint of the over table area of the dishwasher has a dimension of no more than 500 mm×500 mm, and wherein the footprint of the under table area of the dishwasher has a dimension of no more than 400 mm×600 mm; and/or wherein an access opening to the placement area of the dishwasher has a height of no more than 330 mm and a width of no more than 350 mm, wherein the dishwasher comprises a first door, in the form of a Tambour door, for closing the access opening to the placement area of the dishwasher as needed, and also a second door, in the form of a Tambour door, for closing an access opening to the removal area of the dishwasher as needed.

14. Counter module for a counter system, wherein the counter system comprises a counter area having a horizontal counter surface, and wherein the counter module comprises a dishwasher according to claim 1, wherein the over table area of the dishwasher is disposed above the counter surface of the counter area and an under table area of the dishwasher is disposed below the counter surface of the counter area.

15. The dishwasher of claim 1, further comprising a base, wherein the counter structure is supported on the base.

16. A dishwasher for cleaning washware items in the form of drinking vessels, wherein the dishwasher comprises at least one treatment zone and a placement area and a removal area, and wherein the dishwasher further comprises a washing and/or rinsing system having at least one washing and/or rinsing pump and washing and/or rinsing nozzles, via which cleaning liquid, can be sprayed onto the washware items to be cleaned in the at least one treatment zone, wherein the dishwasher is spatially partitioned into an over table area, which, when the dishwasher is used as intended, is positioned above a counter level, and an under table area, which, when the dishwasher is used as intended, is positioned below the counter level, wherein the placement area, the removal area and the at least one treatment zone are respectively part of the over table area, and wherein at least the at least one washing and/or rinsing pump of the washing and/or rinsing system is part of the under table area;

wherein the treatment zone is accommodated within a housing having front, rear, left and right sides, wherein the front side is a placement side of the housing and includes a loading opening, and the rear side is a removal side of the housing and includes an unloading opening, wherein a counter structure extends outward beyond the rear side of the housing and the housing projects upward from the counter structure;

wherein the counter structure is sized and configured such that an area on an upper surface of the counter structure at the removal side of the housing is available as a work surface, wherein said counter level is defined by said upper surface of the counter structure.

17. The dishwasher of claim 16, wherein the counter structure extends outward beyond the front side of the housing, wherein the counter structure is sized and configured such that a further area on the upper surface of the counter structure at the placement side of the housing is available as a further work surface.

18. The dishwasher of claim 16, wherein a lower portion of the loading opening is proximate the counter level and a lower portion of the unloading opening is proximate the counter level.

19. A coffee shop counter system, comprising the dishwasher of claim 16, wherein the counter structure is positioned in the coffee shop to define a customer side and a coffee shop personnel side, wherein the loading opening faces the customer side and the unloading opening faces the coffee shop personnel side.

* * * * *